US007909590B2

(12) United States Patent
Pomar

(10) Patent No.: US 7,909,590 B2
(45) Date of Patent: Mar. 22, 2011

(54) RECIPROCATING COMPONENT-FREE KINEMATIC MOTION APPARATUS FOR TRANSFORMING PRESSURE VARIATIONS OF A FLUID OPERATING IN CYCLICALLY VARIABLE VOLUME TOROIDAL CHAMBERS INTO A MECHANICAL WORK ON A ROTARY AXIS AND ENGINE INCLUDING SAID APPARATUS

(76) Inventor: Eliodoro Pomar, Torremolinos (ES)

( * ) Notice: Subject to any disclaimer, the term of this patent is extended or adjusted under 35 U.S.C. 154(b) by 837 days.

(21) Appl. No.: 11/794,047

(22) PCT Filed: Jan. 13, 2006

(86) PCT No.: PCT/IT2006/000016

§ 371 (c)(1),
(2), (4) Date: Jun. 22, 2007

(87) PCT Pub. No.: WO2006/075353

PCT Pub. Date: Jul. 20, 2006

(65) Prior Publication Data

US 2008/0159897 A1 Jul. 3, 2008

(30) Foreign Application Priority Data

Jan. 13, 2005 (IT) ..... MI2005A0029

(51) Int. Cl.
*F03C 4/00* (2006.01)
*F04C 2/00* (2006.01)
*F04C 18/00* (2006.01)

(52) U.S. Cl. ..... 418/37; 418/35; 123/18 R; 123/241

(58) Field of Classification Search ..... 418/35–38; 123/18 R, 241
See application file for complete search history.

(56) References Cited

U.S. PATENT DOCUMENTS

| | | | | |
|---|---|---|---|---|
| 1,904,892 | A | 4/1933 | Trube | |
| 2,050,603 | A | 8/1936 | Gardner | |
| 2,756,728 | A * | 7/1956 | Mallinckrodt | 418/35 |
| 2,796,216 | A | 6/1957 | Mallinckrodt | |
| 3,092,031 | A | 6/1963 | Pomar | |
| 5,024,192 | A | 6/1991 | Pomar | |
| 6,289,867 | B1 | 9/2001 | Free | |

FOREIGN PATENT DOCUMENTS

| | | |
|---|---|---|
| FR | 2694336 A | 10/1998 |
| GB | 1421926 A | 1/1976 |

OTHER PUBLICATIONS

International Search Report, Dec. 8, 2006.

* cited by examiner

*Primary Examiner* — Theresa Trieu
(74) *Attorney, Agent, or Firm* — Hedman & Costigan, P.C.; James V. Costigan

(57) ABSTRACT

In a cat and mouse type apparatus for transforming volume variations of a plurality of chambers into a rotary motion of an axis, all of the driving mechanism is housed in a cylindric cavity coaxial with the driving axis, between the cylindric cavity, a smaller diameter inner coaxial cylinder and two discs perpendicular to the axis, a toroidal cavity in which are housed rotary pistons, each longitudinally traversed by an axis and having a circular sector in cross-section shape, the rotary pistons rotating to form cavities defined therebetween, also having a substantially circular shape in cross section, where the cavities cyclically change their volumes and an apparatus driving shaft is rotatively driven.

4 Claims, 7 Drawing Sheets

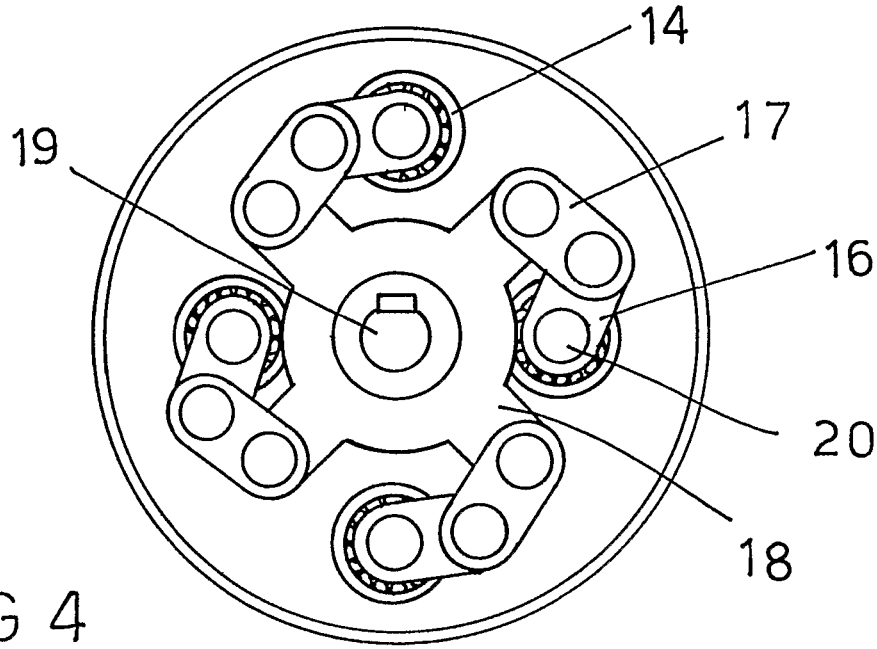
FIG 4
FIG 5
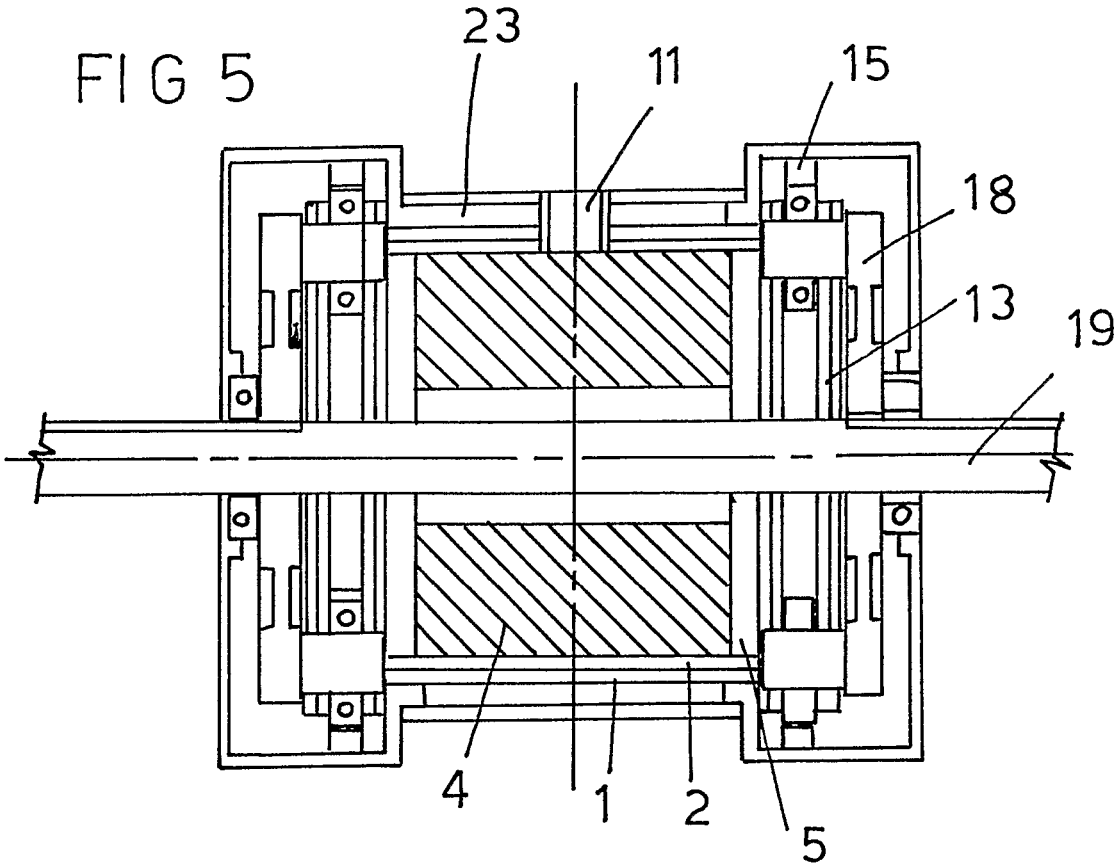

RECIPROCATING COMPONENT-FREE KINEMATIC MOTION APPARATUS FOR TRANSFORMING PRESSURE VARIATIONS OF A FLUID OPERATING IN CYCLICALLY VARIABLE VOLUME TOROIDAL CHAMBERS INTO A MECHANICAL WORK ON A ROTARY AXIS AND ENGINE INCLUDING SAID APPARATUS

BACKGROUND OF THE INVENTION

The present invention relates to a reciprocating component-free kinematic motion apparatus for transforming pressure variations of a fluid operating in cyclically variable volume toroidal chambers into a mechanical work on a rotary axis.

The invention further relates to An engine or motor including such an apparatus.

As is known, a system conventionally used for using the potential energy of a pressurized fluid in earlier steam machines was that of causing said fluid to expand in a cylinder to drive a piston in said cylinder by a connecting rod-crank system, in turn driving a shaft or axis controlling several operating mechanisms or devices.

This system represents, in actual practice, the most frequently used construction to convert the potential energy or power of a fluid into a mechanical work, by expanding the fluid through variable volume chambers.

SUMMARY OF THE INVENTION

The aim of the present invention is to provide such a kinematic motion apparatus or mechanism adapted to advantageously replace, in each desired applications thereof, the mechanisms or devices including the above mentioned cylinder, piston, connecting rod and crank.

In such a kinematic motion apparatus, the rotary working motion is transmitted to the axis by an assembly of elements, all driven with a continuous rotary movement and in a constant direction, which are controlled or driven by toroidal pistons, also rotating coaxially with the axis, and delimiting cyclically variable toroidal chambers which are coupling to the remaining operating elements by simple connecting rod assemblies.

Within the scope of the above mentioned aim, a main object of the invention is to provide such a kinematic motion apparatus, in which the forces generated by said pistons, which are tangentially directed with respect to said axis, are transmitted to said axis so as to minimize the operating losses, thereby allowing to achieve a very high operating efficiency.

Another object of the present invention is to provide such a kinematic motion apparatus which, in particular, is free of any operating forces which, in reciprocating piston engines, tend to urge the piston against the sidewall of the cylinder, thereby causing friction loss and defective sealing problems.

Said forces, as is well known, increase as the angle formed by the connecting rod with the straight line coupling the piston axis with the rotary axis increases.

A further object of the present invention is to provide such a kinematic motion apparatus allowing to obtain a four-stroke cycle without using distributing valves and combusted gas scavenging devices.

According to one aspect of the present invention, the above mentioned aim and objects, as well as yet other objects, which will become more apparent hereinafter, are achieved by a reciprocating component-free kinematic motion apparatus, adapted to transform pressure variations of a fluid operating in cyclically variable volume toroidal chambers into a mechanical work on a rotary axis, characterized in that said apparatus comprises a cylinder, rotary pistons in said cylinder, said rotary pistons having a cross-section having substantially a circular sector shape, said rotary pistons further having radial faces delimiting, with an inner wall of said cylinder, an outer wall of a second inner cylinder coaxial with said first cylinder and inner faces of two discs arranged perpendicularly to the axis of said cylinder, respectively on both size of said pistons, a plurality of cyclically variable volume chambers, each said chamber having a cross-section substantially in the form of a circular sector and each said chamber holding therein a pressurized fluid adapted to provide a potential energy thereof to an axis, so as to turn said axis to cause it to supply an outside mechanical work.

More specifically, the present invention relates to a kinematic motion apparatus comprising four rotary pistons, which are mechanically coupled by pairs, the motion law of which is determined by a symmetric cam, both with respect to its major axis and with respect to its minor axis, said symmetric cam being free of bending points and having a fixed pressurizing rate.

A device for changing the contour of said cam (and accordingly the law determining the piston motion and the pressurizing and expanding rate of said variable volume chambers) even during the operation of the apparatus will also be hereinafter disclosed.

BRIEF DESCRIPTION OF THE DRAWINGS

Further characteristics and advantages of the present invention will become more apparent hereinafter from the following detailed disclosure of a preferred, though not exclusive, embodiment of the invention which is illustrated, by way of an indicative, but not, limitative, example in the accompanying drawings, where:

FIGS. 1-4 are front cross-sectioned views, substantially taken along different cross-section planes, showing the kinematic motion apparatus according to the present invention;

FIG. 5 is a longitudinal cross-sectioned side view of that same kinematic motion apparatus;

DESCRIPTION OF THE PREFERRED EMBODIMENTS

Figure 1:
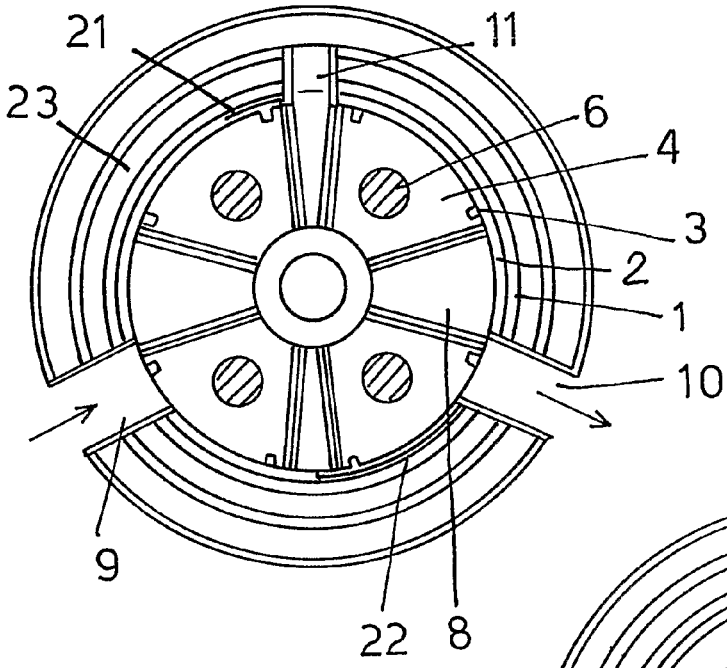
Figure 2:
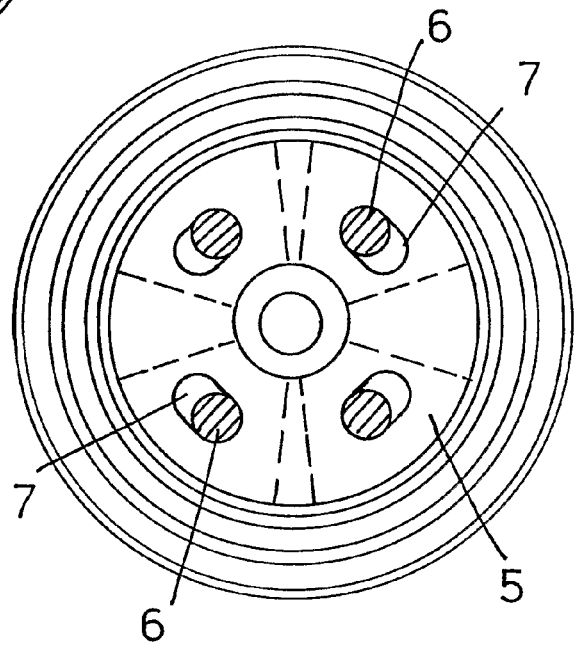
Figure 3:
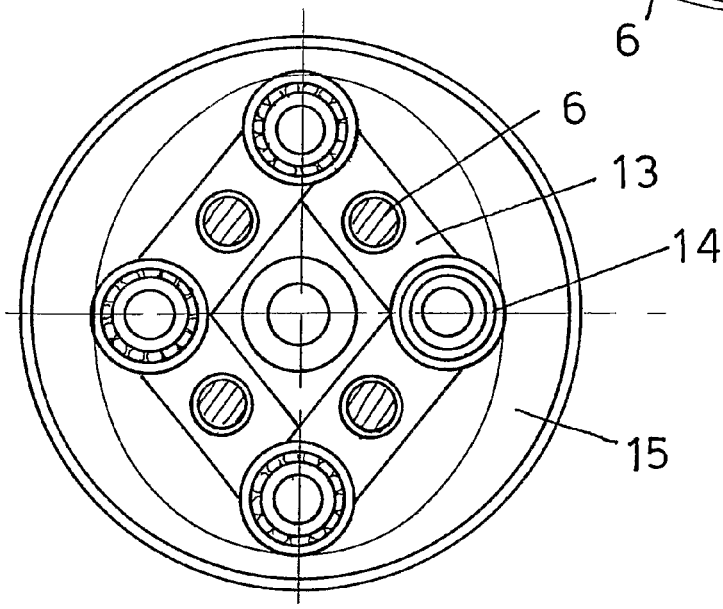
Figure 6:
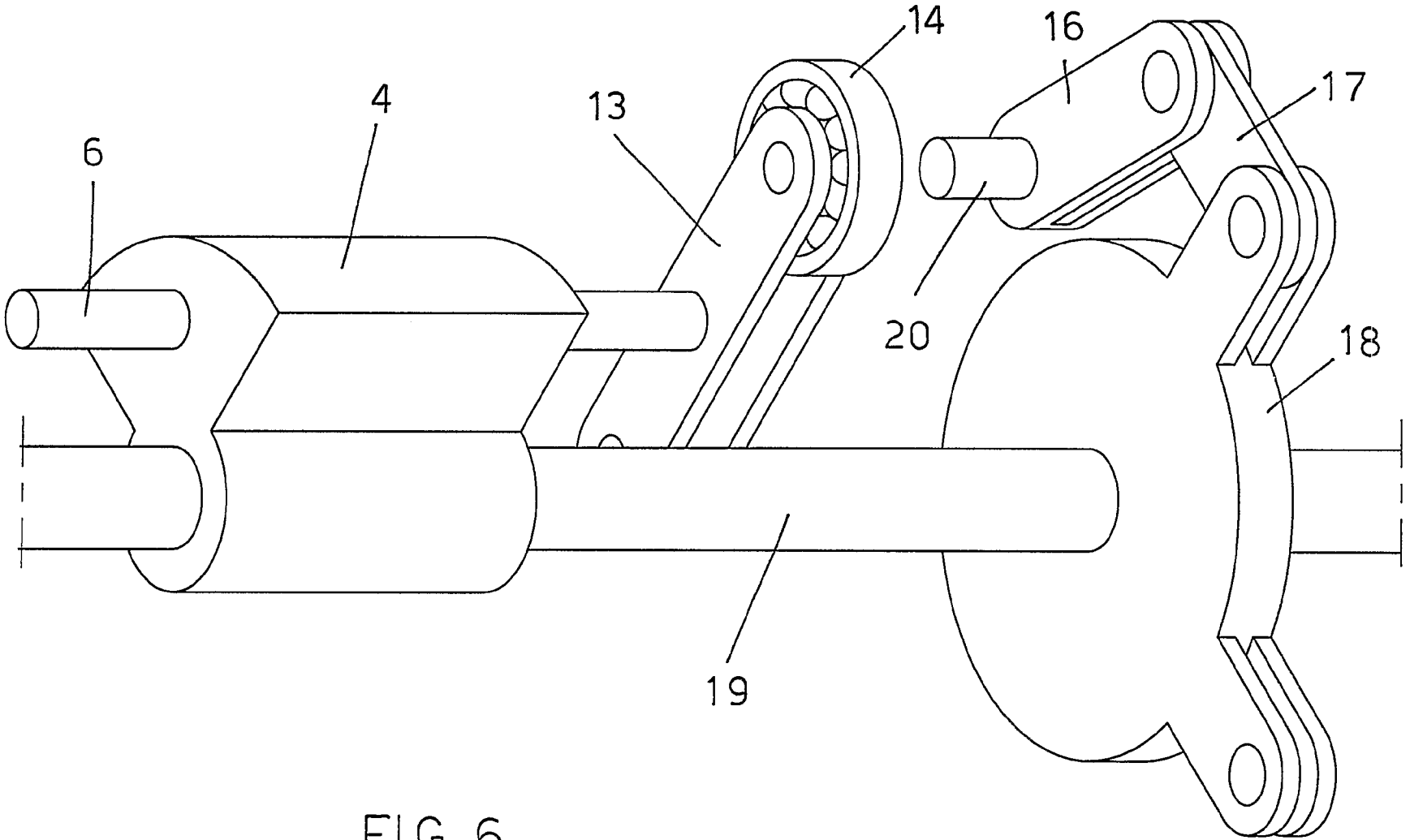
FIG. 6 is a schematic perspective view of said kinematic motion apparatus.
Figure 7:
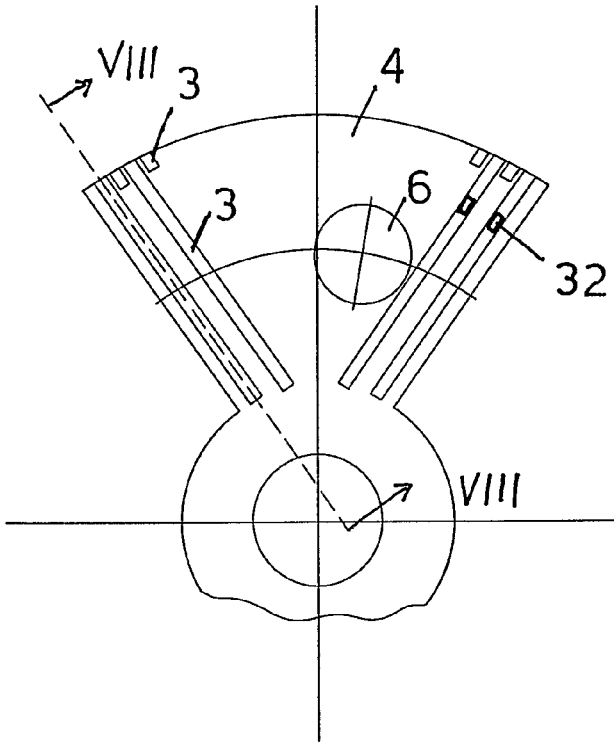
FIG. 7 is a detail front view showing a portion of a kinematic motion apparatus piston.
Figure 8:
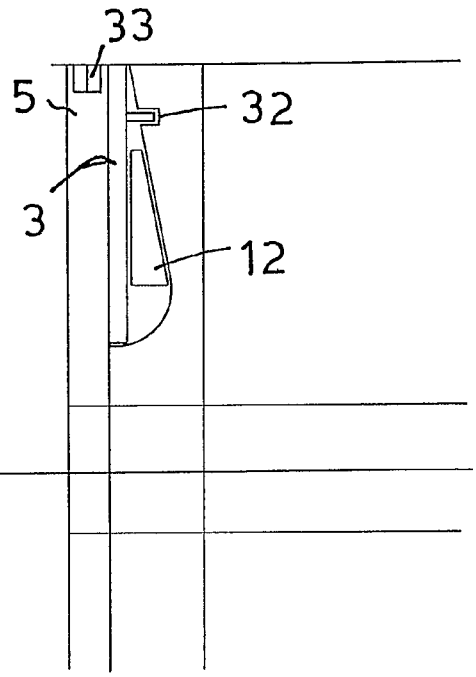
FIG. 8 is a further cross-sectioned view substantially taken along the section plane VIII-VIII of FIG. 7.

With reference to the number references of the above mentioned figures, the kinematic motion apparatus according to the present invention comprises a cylinder 1, including a coaxial liner 2, thereon slide the piston sealing mechanism 3, including a plurality of prismatic elements which, in operation, are urged against the inner wall of said liner by the centrifugal force generated by the rotary pistons.

As the apparatus is in a stop or rest condition, the sealing prismatic elements can be tightly coupled, if necessary, by waved steel springs, not specifically shown.

The above mentioned sealing elements are engaged in suitable cavities formed on the piston walls, said pistons having the shape of a circular sector the length of which is delimited by two front disc elements 5, including elongated slots 7 therethrough the axes of said pistons 6 pass, thereby allowing said pistons to be mutually driven toward one another and away from one another. This movement, in particular, will cause, as already stated, a volume variation of said chambers 8 including said operating fluid therein.

The disc elements 5 comprise, in turn, corresponding sealing resilient circular ring elements or bands 33.

Through the cylindric body of the subject mechanism a plurality of operating fluid inlet and outlet ports are provided and, if the apparatus or mechanism is used as an internal combustion engine, said cylindric body further comprises a plurality of operating holes for engaging therein operating elements such as spark plugs, injectors or other necessary operating devices.

In such a case, and as shown in the drawings, an inlet port 9, an outlet port 10, a sparking plug hole 11 and a fuel injector hole are moreover provided, if the operating cycle requires said elements.

At the contact surfaces of the front disc elements 5 and front faces of the pistons 4 sealing elements are provided, also including a plurality of prismatic elements urged against the walls by small wedge-like masses 12 which subject said elements to the pressure as generated by the centrifugal force.

The piston motion, due to the operating fluid pressure, is transmitted from the axes of said pistons 6 to the connecting rod 13 leverage, the connecting rods of which pass through bearings 14 rolling on the inner wall of the cam 15, while deforming the articulated polygon including said connecting rods 13 and thereby causing the rotary speed about the principal axis of the respective pistons to cyclically change.

On the axis of each said bearing 14 corresponding pins 20 are housed, each of which transmits the motion received by the pistons to two small connecting rods 16, 17, the connecting rod 17 being, in turn, pivoted to a crank element 18 rigid with the axis of the engine 19, for providing the desired operating work.

Each connecting rod pair provides a connection between the end axis of a variable length which can vary from a maximum to a minimum preset value.

In this connection it should be apparent that the disclosed device can also be conceptually replaced by link elements, directly mounted on the crank 18 and including a respective shoe also directly mounted on the pivot pin 20.

The two above disclosed mechanisms, while being theoretically equivalent from a motion transmission standpoint, have each mechanical advantages and drawbacks, thereby a designer can use either one or the other of it depending on the specific application.

In particular, by using either one or the other of the above mentioned mechanisms, each of said pistons will be directly coupled to the engine or motor axis.

Thus, in addition to an optimum transmission of the generated power, a proper connection between the mechanism axis and the axis of an ideal plane dividing into two radially symmetrical half portions each of said chambers 8 will also be assured.

Such a correspondence would be required to provide a perfect like correspondence of the distributing step or stroke in each said chamber.

It would be preferable to arrange said small connecting rods 16 and 17 in opposite directions with respect to the motion for each of the two end faces of the mechanism, so as to alternately mutually connect each pin of the crank to the bearings 14.

In this connection it should be pointed out that, if the disclosed mechanism or apparatus is used to operate as an internal combustion four-stroke engine, then said operating cycle will be performed for each chamber in a single revolution of the engine shaft.

Since in the disclosed mechanism or apparatus the number of said chambers is four, the operation of said apparatus will be equivalent, from a generated power standpoint, to that of a four-stroke and four cylinder engine, having a total piston displacement equal to the sum of the maximum volumes of each said chambers.

The absence of valves, the small size of the related ports, the small distance of the inlet and outlet ports (with a consequent drastic reduction of the losses due to uncombusted materials), the absence of friction losses both in the main mechanism and in the auxiliary mechanisms, will assure a high operation efficiency and a small pollution.

Moreover, a perfect balancing of the rotary masses and balancing and distributing of the forces, will allow to achieve a very high revolution number and, accordingly, to increase the specific power.

Thereinbelow a comparing between the distributing of the forces in a reciprocating piston mechanism and the distributing of the forces in a rotary piston mechanism corresponding to the above disclosed mechanism will be carried out.

Figure 11:
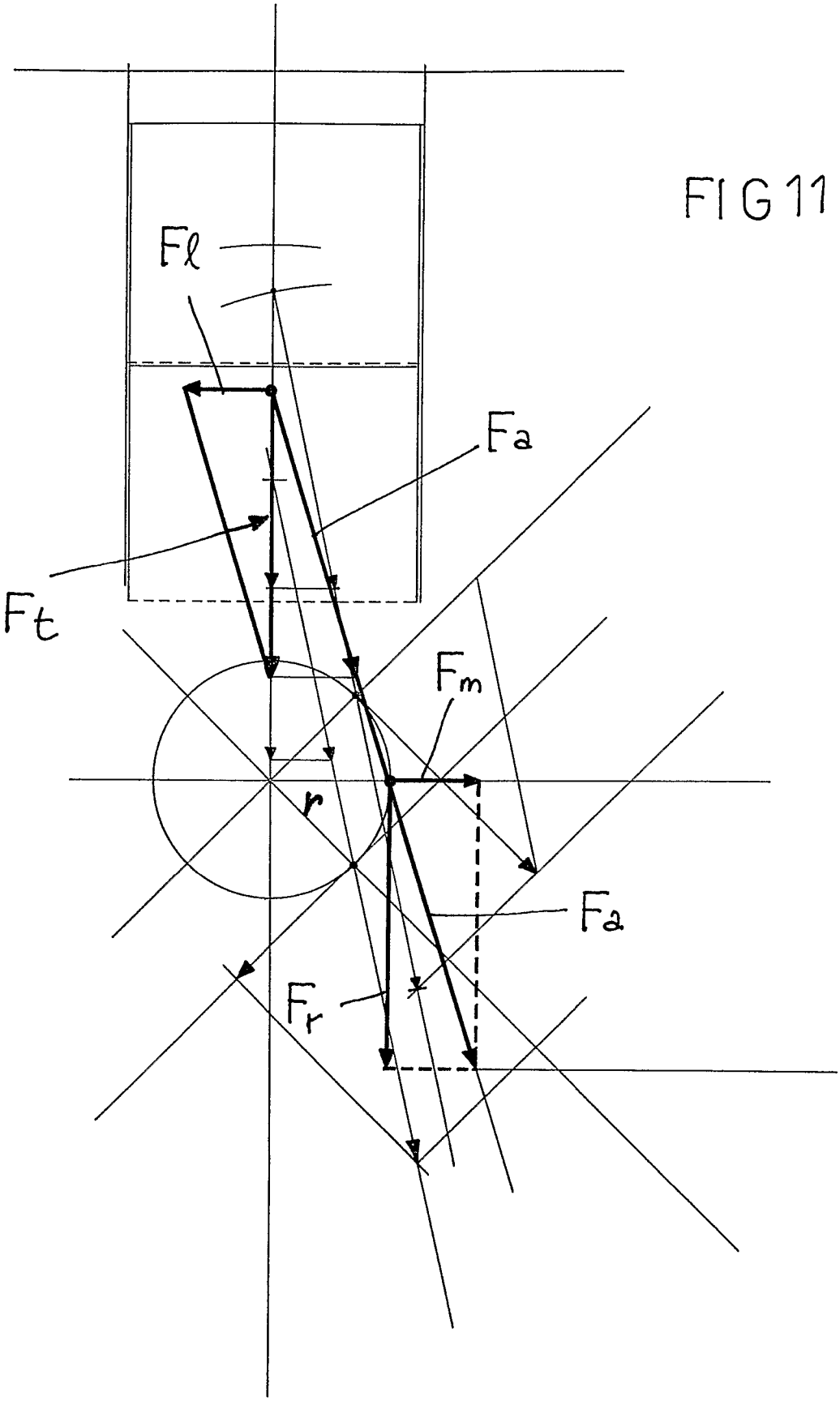
FIG. 11 is a schematic diagram showing the distribution of the forces in a reciprocating motion piston apparatus or mechanism.
Figure 12:
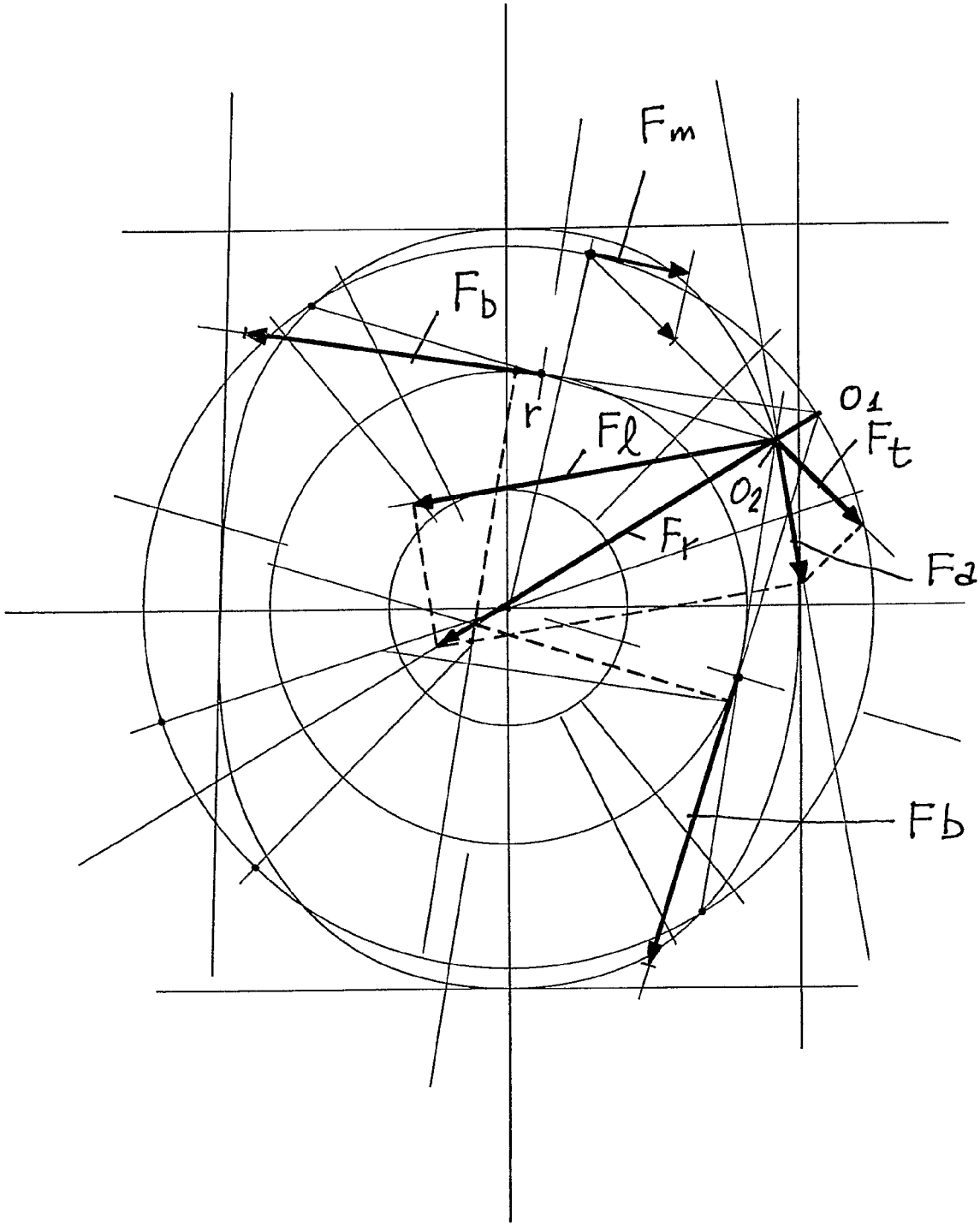
FIG. 12 is a further schematic diagram showing the distribution of the forces in a rotary piston mechanism or apparatus.

For performing such a comparation, two strictly comparable mechanisms, which have been schematically shown respectively in FIGS. 11 and 12, have been selected.

In both cases, we will assume that the force generated by the pressure acting on the piston active surfaces of the two mechanisms is schematically indicated by a vector having a length of 50 mm, indicated by Ft, and conventionally considered equal to 50 Kg.

We will consider, at first, FIG. 11.

The vector Ft, according to the line joining the axis of the piston and the axis of the mechanism, does not directly generate any works but, by decomposing it into the two forces Fa and Fl, the first will operate along the connecting rod and the second on the piston sidewall, so as to generate friction against the cylinder sidewall thereby negatively affecting the resilient piston ring sealing.

With respect to the force Fa, which can in be in turn decomposed into the forces Fr and Fm, said force Fa will rotatively drive the crank coupled to the axis, whereas the force Fm will not generate any useful work.

Accordingly, in the disclosed apparatus or mechanism, the maximum torque will correspond to the product Fr×r; in the considered case, a graphical calculation will provide a torque of about 100 Kg/cm.

We make now reference to FIG. 12.

In this case, the movable surfaces comprise two movable surfaces.

The above considered conventional force will be equally discharged on the two pistons, the walls of which will form the chamber in a tangential direction with respect to the circumference followed by the axes of the related pistons.

Thus, said forces, by combining with another, will provide a resultant force applied at the point O1 which force will be indicated by Fr, and will pass through the axis of the mechanism, without producing any rotary movements.

The connecting rods, which are pivoted on the piston axis and which, at their end portions, bear the rolling bearings contacting the cam, will discharge this force on the walls of said cam, at the point O2, where said force will be decomposed into the force Fa, tangential to the surface of the cam and the force Fl, which will be discharged perpendicularly thereto.

Then, the piston assembly is rotatively driven under the effect of the force Fa which, through the connecting rods 16 and 17 will be transmitted to the crank coupled to the axis, thereby providing the force Fm, directed tangentially to the arm of the crank 18, thereby causing the axis to be rotatively driven.

Accordingly, in this case, the driving torque will correspond to Fm×r, where r is the crank radius.

According to the above indicated graphical calculation, even in this case the maximum driving torque, for the above indicated values, will be of about 100 Kg/cm.

Thus, the two disclosed mechanisms, will be, from an approximate examination and a generated maximum driving torque standpoint, practically equivalent, even if the parameters related to the forces and arms will have a value which is remarkably different in the two cases and even if the average driving torque value of the mechanism or apparatus according to the present invention will be remarkably larger.

Sealing Systems:

One of the most serious problems affecting the subject rotary mechanism or apparatus, with respect to prior reciprocating piston mechanisms of similar characteristics, is the larger length of the sealing lines, in the two considered cases, and the presence, in the rotary mechanisms, of flat faces and corners.

Tests performed on Wankel's engines have partially overcome the above mentioned drawbacks, but, in a same degree, they yet exist, since it is actually true that rotary mechanisms have the above mentioned characteristics; for example, in a mechanism or apparatus like that herein disclosed, the linear extension of the sealing elements can vary from a double to a triple value of that of a corresponding reciprocating piston engine, according to the preset constructional parameters.

However, what must be considered is the different quality of the sealing devices.

As already mentioned, in reciprocating piston engines, the contact between the cylinder and piston is affected by slanted urging forces, of objectable nature which, in a rotary piston mechanisms, are actually absent.

The mentioned urging forces causes the contact between the cylinder and reciprocating piston not to occur between well coupled cylindric surfaces and with parallel generatrix lines, but, instead, between the piston ring corners and cylinder surface.

Moreover, the contact pressure in the mentioned mechanisms is very low, since it is exclusively supplied by the piston ring elasticity and since it is well known that such an elasticity, at a comparatively high operating temperature, tends to further decreases.

Vive versa, in the rotary mechanism or apparatus, the centrifugal force is always directed in a direction perpendicular to the inner surface of the cylinder. Moreover the surface of the sealing prismatic elements is perfectly coupled or mated with the inner surface of said cylinder.

In addition, the centrifugal force, assuring the contact of said surfaces, increases with the rotary speed, thereby providing a sealing effect at high revolution ranges, to which will correspond a maximum power.

Furthermore, at the mentioned flat surfaces, said wedge elements subjected to the centrifugal force will provide, on these particularly critical surfaces, a very satisfactory sealing effect.

In this case, the prismatic sealing elements will comprise a detent nose 32, to prevent the centrifugal force to offset them from a proper operating position.

In mechanisms designed to operate as internal combustion engines, a specifically designed arrangement of the sealing prismatic elements at the piston region passing on the sparking plug electrodes will allow to perform a spark advancing and modify it as the motion pattern changes.

A channel formed in the liner 2 will provide an extension of the combustion chamber which, by operating as a flame channel, permits to ignite the fuel mixture at the desired time.

A like channel 22, formed at the outlet port of the liner, permits to fully discharge from the combustion chamber the combusted gas residues.

Lubricating And Cooling.

If this kinematic motion apparatus or mechanism is used to convert into mechanical work the potential energy of a pressurized fluid, then no inherent problem related to these two functions exists.

In this case, the lubricating of the elements constituting this mechanism can be assured by simple and well known means, and the same thing can be said for an optional cooling.

As, on the contrary, the mechanism is used for an internal combustion engine, then, in the latter, a comparatively large heat development will occur in said mechanism.

In such a case, both lubricating and cooling must be accurately considered, with respect to the particular distribution of heat generated on the outer surface of the cylinder, and the difficulty of removing the heat from the innermost portions of the engine.

With respect to the first of the above mentioned problems, it has been already solved during tests performed on the Wankel's engine, and does not constitute a novel problem.

In this connection it should be pointed out that explosions occur at a narrow region of the cylinder, which, accordingly, is subjected to thermal dilatation stresses, tending to ovalize the cylinder, and cause possible operation alterations.

This drawback, and the high amount of generated heat due to the high specific power which can be obtained by this mechanism, can be eliminated by suitably distributing the cooling fluid or providing heat exchange surfaces specifically designed depending on the contingent requirements.

With respect to the above mentioned second problem, that is to prevent the temperature of inner parts of the engine from exceeding allowed limits, imposed by the strength of the material used for making the engine, it is possible to follow two paths, i.e. to remove the generated heat by a suitably forced circulation of the lubricating oil, or use a material adapted to resist against high operating temperatures, for example a ceramics material.

This can be theoretically studied in a first approximation, and then can be further improved by actually considering the parameters detected during the testing of prototypes.

The drawings schematically show a combustion chamber 23, ideally provided for circulating a refrigerating or cooling fluid.

This kinematic motion apparatus or mechanism allows, moreover, to practically made a machine which can be called a "constant-volume combustion turbine".

This machine has been constructed only in some experimental prototypes, which, however, have not up to now brought to practically interesting applications, due to the constructional difficulties shown thereby.

This machine differs from a well known constant-pressure turbine, since its combustion chamber comprises suction and outlet valves, and, accordingly, it appears as natural to compare it to a combination of a reciprocating engine and a discharge gas turbine; the practical difficulties found in making it actually consist of assuring a proper operation of the mentioned valves.

By using, instead of a reciprocating engine, a kinematic motion apparatus like that which has been above disclosed, not requiring valves to carry out a fourth-stroke cycle, this difficulty is removed, thereby allowing to easily make this type of machine which, the jet temperature being the same, allows to use a larger maximum temperature in the operating cycle, thereby providing a higher thermal efficiency.

This machine can be used according to two operation modes, in the first of which the axis can supply a portion of the propulsion work (as, for example, in a turbo-propeller engine), and the remaining part can be supplied by the jet, whereas, in the second mode of operation, the overall propulsion work can be supplied by the jet, the axis transmitting to the piston only the work necessary to compress the cycle operating air.

In both the above mentioned cases, the jet energy will be sum of the pressure energy generated by the fuel combustion and the kinetic energy acquired from the centrifugal force, during the rotary operation of the toroidal pistons.

Cam Profile And Possibility of Changing It Even During the Operation of the Apparatus Or Mechanism:

As already therein above disclosed, the kinetic motion apparatus or mechanism shown in the drawings comprises a cam 15 having a fixed and double symmetrical profile or contour, both with respect to the maximum and minimum diameter axis.

Actually, the above mentioned two characteristics are not essential to provide cam elements compatible with the operation of a mechanism like that therein above disclosed.

In fact, the cam profile can be changed, as it will be disclosed hereinafter, and also be made asymmetrical to enhance the piston working cycle operating step duration, such as, for example, the expansion and suction steps or strokes, with respect to the discharging stroke of an optional internal combustion engine.

To define the cam profile or contour, after having set to motion law to be assigned to the pistons, and consequently the angle to be assumed by each of said piston, at any desired times, with respect to adjoining pistons, it is possible to carry out a cam profile defining method, comprising a point-per-point type of logging, by calculating the distance to the axis of each point thereof, by using the relationship:

$$X = r\cos\frac{\vartheta}{2} \pm \sqrt{a^2 - r^2 sen^2\frac{\vartheta}{2}}$$

In this relationship x is the distance of a cam point from the mechanism axis, r is the radius of the circumference followed by the piston axis during the piston movements, a is the length of the connecting rod coupling the end points of x and r and $\vartheta$ is the angle included between the radii joining to the main axis of the mechanisms the axes of two adjoining pistons.

This formula supplies values which are sufficiently accurate to assure a proper operation of the proposed mechanism or apparatus.

Therein below will be disclosed a method for making a double symmetrical variable profile cam, during the operation of the kinematic motion mechanism or apparatus, to change the compression and expansion ratio in the chamber holding the operating fluid.

In this connection it should be pointed out that the mentioned ratio will actually depend on the cam maximum diameter and minimum diameter ratio.

Figure 9:
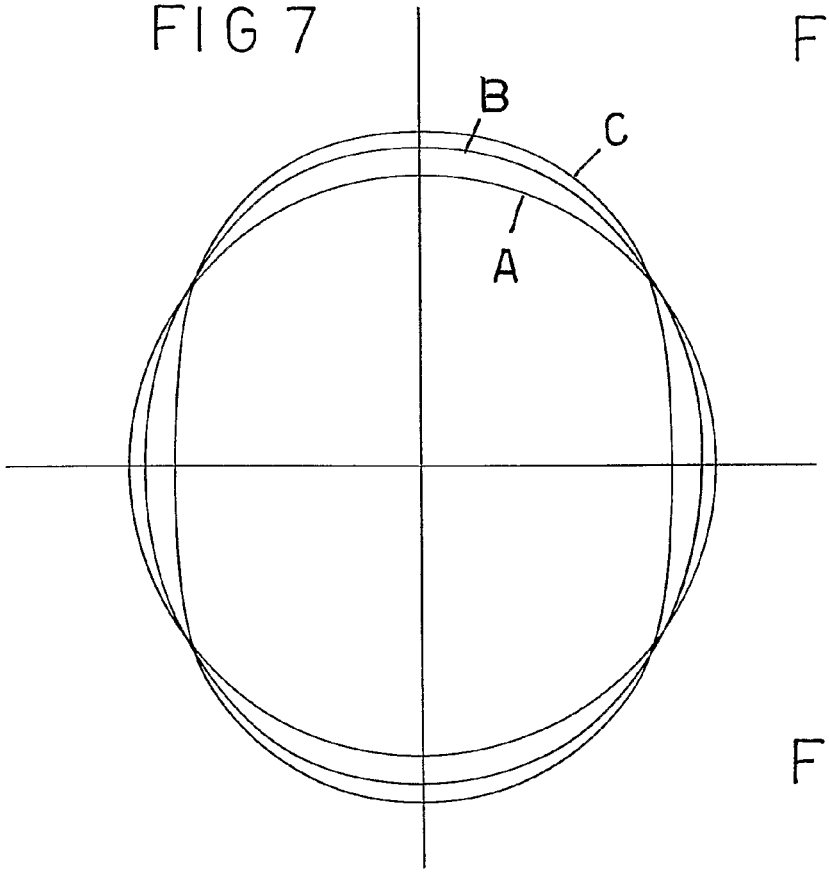
FIG. 9 is a schematic diagram, showing the active contours or profiles of three symmetrical cams, which are mechanically compatible with the kinematic motion apparatus shown in the preceding figures.

FIG. 9 schematically shows the active profiles or contours of three symmetrical cams which are mechanically compatible with the above disclosed mechanism.

They have been indicated by the letters A, B and C; whereas the cam A has a circular profile and accordingly corresponds to a mechanism having a compression rate corresponding to zero (the chamber volume being constant), the cam C corresponds to a mechanism having an infinite compression rate (with the minimum volume of the chamber theoretically corresponding to zero).

Between the two above mentioned limit values, all the cam profiles B related to middle value maximum respectively minimum diameters will be included, so as to provide all the desired and possible compression ratios.

It should be apparent that the curvilinear cam can be replaced by an envelope of a set number of tangent lines thereof, defining the positions of the characteristic points of the cycle to be performed.

Figure 10:
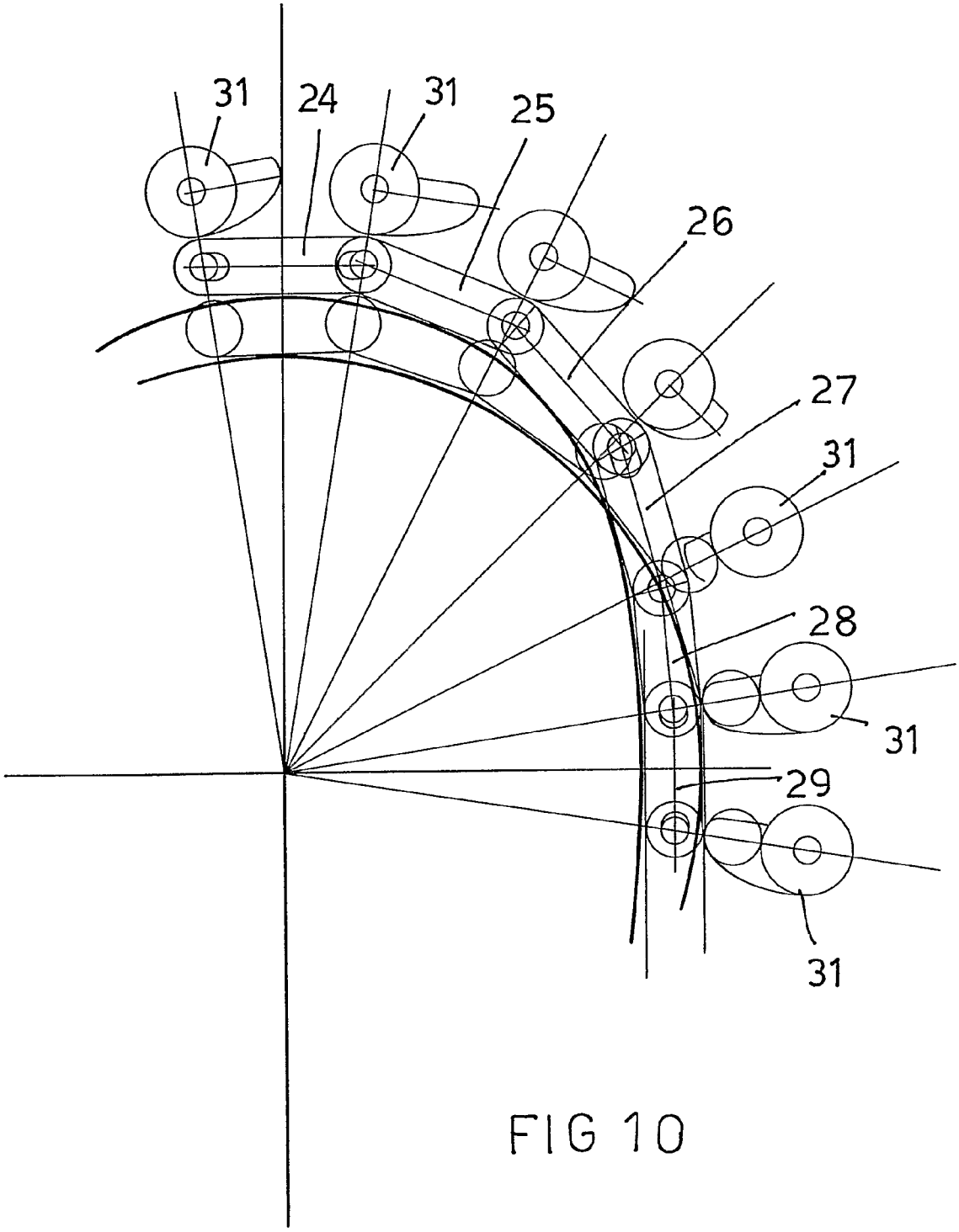
FIG. 10 shows a fourth portion of the cam, the overall active surface thereof is considered as sufficiently and fully materialized by twenty rectilinear elements tangent thereto.

FIG. 10 shows only a fourth portion of the cam, the overall active surface of which is considered as sufficiently and fully materialized by twenty rectilinear elements tangent thereto.

Of said rectilinear elements, those which are perpendicular to the maximum and minimum diameters 24 and 29 are bound to the cylinder, so as to be displaced only in a radial direction along said diameters, whereas the other elements, indicated by the reference numbers 25, 26, 27 and 28 are coupled to one another, and to the elements 24 and 29, by coupling pins, to provide a closed loop or chain pattern.

Each element of said chain is outwardly urged by a spring system, not specifically shown in the drawings for simplicity. Their outward displacement is however limited by an abutment against a plurality of eccentric elements 31 which are kinematically coupled to one another by coupling levers or gears, also not specifically shown.

Thus, as each said gear turns about its axis as controlled by an outer control element, it will allow the cam to continuously change its shape, by gradually passing from the configuration A to the configuration C and vice versa.

In the drawing, this variation is fully performed as each of said eccentric elements perform a rotary movement through 90° about its axis.

Preferably, the shape or contour of said eccentric elements will be so designed that, as said eccentric elements turn, the assembly of their points tangent to an ideal cam shape corresponding to this position would be proper and compatible with one of the motion laws, as provided for the pistons.

It should be apparent that the pattern or shape variation of the surfaces tangent to the cam can also be obtained by other types of mechanisms, for example oleopneumatic, electric or mixed systems.

Thus, it should be apparent that the above mentioned mechanical system has been disclosed only to clarify the inventive concept and to show a possible embodiment thereof.

As a possible application thereof we will indicate, by way of an example, that related to a mechanism designed for performing the functions of an internal combustion engine, in which it is possible to change, even during its operation, both the compression and the expansion rate.

This possibility, which can be hardly obtained by reciprocating piston mechanisms, provides the engine with a great operating flexibility, which could not be obtained in other manners, by simple means which operate simultaneously and in a same degree for each cylinder-piston mechanism of the conventional reciprocating engine.

The above mentioned possibility will be very important in engines designed for operating based on a lot of different fuel materials.

A further important aspect is represented by the possible shape variations which can be made in the chambers therethrough the mixture flows, to improve their volume/surface ratio and a consequent propagation of the flame front.

In fact, whereas in the Wankel's engine the chamber shape is fully bound to the geometry of the kinematic motion apparatus and is very disadvantageous both for providing a good combustion and for transmitting the forces generated thereby to the active mechanical parts of the engine, in the subject mechanism, on the contrary, it is possible to exploit a lot of possibilities for affecting the geometrical parameters of said chamber, and this both varying the cylinder diameter/length ratio and changing the configuration of the piston radial walls.

In fact, it is herein possible to form cavities of suitable (for example semispherical) shape to allow the flame front to extend under very improved conditions, in particular in the chamber minimum volume pattern, which, in this connection, would be the most critical one.

In addition to the above mentioned advantages, it is furthermore possible to obtain a reduction of all the inertia forces caused by a variation of the reciprocating mass speed, a reduction of the mechanical fatigue induced by the reciprocating elements due to a cyclic reversal of the forces along the axis thereof, and a splitting of the efforts in two mechanisms symmetrically arranged on the faces perpendicular to the axis of the cylinder including the subject mechanism assembly.

In this way, there is a sufficiently clear picture of the mechanical reasons that make it possible and convenient to construct a unit of compactness and strength never previously obtained by mechanisms provided with reciprocating pistons.

With respect to the mechanism construction, it will comprise a variable number of pistons and chambers.

From a conceptual standpoint, this number could be either even or odd, depending on a performance to be obtained.

Even if the above disclosed mechanism is suitable to transform into work the pressure potential energy of both anelastic and elastic fluids, and to convert a mechanical work into a fluid pressure variation, reference will be made hereinafter only to its use with resilient or elastic fluids, and a specifical reference will be made both to those fluids already compressed outside of the mechanism, and to the fluids compressed in said mechanism, and this particularly in connection to its use for making internal combustion engines.

It has been found that the invention fully achieves the intended aim and objects.

In fact, the invention provides a kinematic motion apparatus or mechanism in which the force which in reciprocating piston engines, tends to urge the pistons against the cylinder sidewalls, thereby causing friction losses and a defective sealing, is fully absent.

In the above shown example, has been disclosed a mechanism or apparatus comprising four variable volume toroidal chambers and four pistons rigid by pairs.

This arrangement allows to provide a mechanism in which the variable volume chambers assume, during a revolution, for two times the maximum volume and for two times the minimum volume.

Thus, for each revolution, it is possible to provide an operating cycle comprising two expansions, for a case in which it would be desired to expand an already compressed fluid, and a full suction, compression, combustion, expansion and discharging cycle, in a case in which the mechanism would be used for providing the four-stroke operating cycle of an internal combustion engine.

In such an application, the adopted arrangement will allow to perform the four-stroke cycle in a single revolution without using valves.

Such a solution provides great mechanical and constructional advantages since simple ports, like those of a two stroke reciprocating engine would be sufficient, and this however, without the related drawbacks.

The scavenging step is also fully eliminated, since the empting of the combusted gas chamber is assured by the mechanical construction of the device.

Thus, from a constructional standpoint, the mechanism can be considered as generally comprising three discrete parts, i.e: the first part formed by the mechanical parts defining and holding therein the variable volume chambers (essentially the cylinder, toroidal pistons, front discs and sealing elements.

The second comprises the mechanical parts causing the chamber volume to be cyclically changed (connecting rods, cams and rolling bearings).

The third is formed by mechanical parts designed for transmitting to the axis the piston motion (such as connecting rods and crank coupled to the engine or driving axis).

In practicing the invention, the used materials, as well as the contingent size and shapes, can be any, depending on requirements and the status of the art.

The invention claimed is:

1. A reciprocating component-free kinematic motion apparatus, to transform pressure variations of a fluid operating in cyclically variable volume toroidal chambers into a mechanical work on a rotary axis of said apparatus, said apparatus comprising a cylinder, rotary pistons in said cylinder, each said rotary piston having a circular sector cross-section, a piston wall, a piston axis, two piston sides and a piston front face, between two adjoining said piston sides of each said pair of said piston being defined a cyclically variable volume circular sector cross-section chamber, said cylinder including a coaxial liner, thereon a plurality of piston prismatic sealing elements slide, said sealing elements being centrifugally urged against an inner wall of said liner, said prismatic sealing elements being optionally tightly resiliently coupled, and being engaged in cavities formed on each said piston wall, said pistons being delimited by two front disc elements, including elongated slots therethrough said axes of said pistons pass, to allow said pistons to be mutually driven toward one another and away from one another to in turn cause a volume variation of each said chamber, said disc elements comprising sealing elements arranged between contact surfaces of said disc elements and said piston front faces, said disc sealing elements including a plurality of prismatic elements centrifugally urged by wedge urging masses, said axes of said pistons being coupled to a connecting rod leverage, the connecting rods of which pass through bearings rolling on an inner wall of a cam, while deforming an articulated polygon including said connecting rods thereby causing a rotary speed of said pistons to cyclically change, wherein said bearings axially support pin elements, each said pin element being coupled to a said piston and to a first and second connecting rod being pivoted to a crank element of said apparatus.

2. The apparatus according to claim 1, wherein said first and second connecting rods are coupled in opposite directions so as to alternately mutually connect each said pin to each said bearings.

3. The apparatus according to claim 2, wherein each said prismatic sealing element comprises a detent nose to prevent said prismatic sealing element from being centrifugally offset from a set operating position thereof.

4. The apparatus according to claim 1, wherein said cam has a cam symmetrical or asymmetrical profile varying according to a relationship $$X = r\cos\frac{\partial}{2} \pm \sqrt{a^2 - r^2 sen^2\frac{\partial}{2}}$$

where: x is a distance of a cam point from the apparatus axis, r is a radius of a circumference followed each said piston axis, a is a length of a connecting rod coupling end points of x and r and is an angle included between the radii joining said pistons.

* * * * *